US006966239B2

(12) United States Patent
Lai

(10) Patent No.: US 6,966,239 B2
(45) Date of Patent: Nov. 22, 2005

(54) DRIVING SHAFT FOR A RATCHET SPANNER

(75) Inventor: Yeong-Fa Lai, Taichung (TW)

(73) Assignee: Gau Jiing Industrial Co., Ltd., Taichung (TW)

( * ) Notice: Subject to any disclaimer, the term of this patent is extended or adjusted under 35 U.S.C. 154(b) by 0 days.

(21) Appl. No.: 10/826,758

(22) Filed: Apr. 15, 2004

(65) Prior Publication Data

US 2005/0132846 A1 Jun. 23, 2005

(30) Foreign Application Priority Data

Dec. 18, 2003 (TW) ..... 92222178 U

(51) Int. Cl.[7] ..... B25B 13/46
(52) U.S. Cl. ..... 81/57.39; 81/438
(58) Field of Search ..... 81/57.39, 125, 81/438, 439, 460

(56) References Cited

U.S. PATENT DOCUMENTS 4,722,252 A * 2/1988 Fulcher et al. ..... 81/57.39
4,987,802 A * 1/1991 Chern ..... 81/57.39
5,042,333 A * 8/1991 Huang ..... 81/438
5,481,949 A * 1/1996 Yen ..... 81/438
5,967,002 A * 10/1999 Pijanowski ..... 81/57.39
6,189,419 B1 * 2/2001 Pijanowski ..... 81/57.39
6,705,183 B1 * 3/2004 Dickens ..... 81/437

* cited by examiner

*Primary Examiner*—David B. Thomas
(74) *Attorney, Agent, or Firm*—David T. Millers

(57) ABSTRACT

A driving shaft for a ratchet spanner includes a shaft body and a sleeve-retaining member. The shaft body includes a polygonal driving end that is adapted to be received fittingly within a wrench sleeve and that has an end surface with a polygonal screwdriver-engaging groove adapted for receiving a head of a screwdriver fittingly, and an annular outer surface that is formed with a hole communicated with the screwdriver-engaging groove in the end surface. A sleeve-retaining member is disposed within the screwdriver-engaging groove in the shaft body, and has an integral projection that extends through the hole in the shaft body and that is adapted to be biased to press against the wrench sleeve so as to retain the wrench sleeve on the driving end of the shaft body.

3 Claims, 7 Drawing Sheets

DRIVING SHAFT FOR A RATCHET SPANNER

CROSS-REFERENCE TO RELATED APPLICATION

This application claims priority of Taiwanese Application No. 092222178, filed on Dec. 18, 2003.

BACKGROUND OF THE INVENTION

1. Field of the Invention

This invention relates to a ratchet spanner, and more particularly to a driving shaft for a ratchet spanner, which can be coupled with a selected one of a wrench sleeve and a head of a screwdriver.

2. Description of the Related Art

Referring to FIG. 1, a conventional pneumatic ratchet spanner is shown to include a handle 1 with a driving mechanism (not shown) disposed therein, a ratchet seat 2 disposed at a front end of the handle 1, and a ratchet device 3 disposed within the ratchet seat 2 and driven by the driving mechanism (not shown). The ratchet device 3 includes a polygonal driving shaft 301 and a sleeve-retaining member 302 that is configured as a spring-biased ball, which is biased to project outwardly of the driving shaft 301 so as to press against a wrench sleeve (not shown) sleeved on the driving shaft 301, thereby retaining the wrench sleeve (not shown) on the driving shaft 301. The driving shaft 301 suffers from the following disadvantages:

(1) The driving shaft 301 cannot be connected directly to a head of a screwdriver for rotating the same.

(2) It is difficult to mount the sleeve-retaining member 302 on the driving shaft 301.

SUMMARY OF THE INVENTION

The object of this invention is to provide a driving shaft for a ratchet spanner, which can be connected to a wrench sleeve or a head of a screwdriver and which includes a sleeve-retaining member which can be mounted easily on a shaft body.

According to this invention, a driving shaft for a ratchet spanner is provided. The ratchet spanner has a spanner body, and is adapted for connection with one of a wrench sleeve and a polygonal head of a screwdriver. The driving shaft is journalled on the spanner body, and includes a shaft body and a sleeve-retaining member. The shaft body includes a polygonal driving end that is adapted to be received fittingly within the wrench sleeve and that has an end surface with a polygonal screwdriver-engaging groove adapted for receiving the head of the screwdriver fittingly, an annular outer surface that is formed with a hole communicated with the screwdriver-engaging groove in the end surface, and an annular inner surface that defines the screwdriver-engaging groove therein. The sleeve-retaining member is disposed within the screwdriver-engaging groove in the end surface of the driving end of the shaft body, and has an integral projection that extends through the hole in the shaft body and that is adapted to be biased to press against the wrench sleeve so as to retain the wrench sleeve on the driving end of the shaft body.

In one preferred embodiment, the sleeve-retaining member is configured as a U-shaped reed spring that includes two parallel side plates which abut against the annular inner surface of the driving end of the shaft body. The side plates of the sleeve-retaining member are adapted to flank and abut against the head of the screwdriver. The projection is formed integrally with one of the side plates of the sleeve-retaining member. The driving end of the shaft body further has a polygonal planar surface that defines a closed end of the screwdriver-engaging groove in the shaft body. The sleeve-retaining member further includes an elongated connecting plate that has two ends formed respectively and integrally with the side plates and that abuts against the polygonal planar surface of the driving end of the shaft body. Each of the side plates of the sleeve-retaining member has a free end. The annular inner surface of the driving end of the shaft body is formed with an annular groove. The driving shaft further includes a C-shaped retaining ring that is received within the annular groove in the shaft body and that abuts against the fee ends of the side plates of the sleeve-retaining member so as to fix the sleeve-retaining member within the screwdriver-engaging groove in the driving end of the shaft body. As such, the sleeve-retaining member can be mounted easily on the shaft body.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
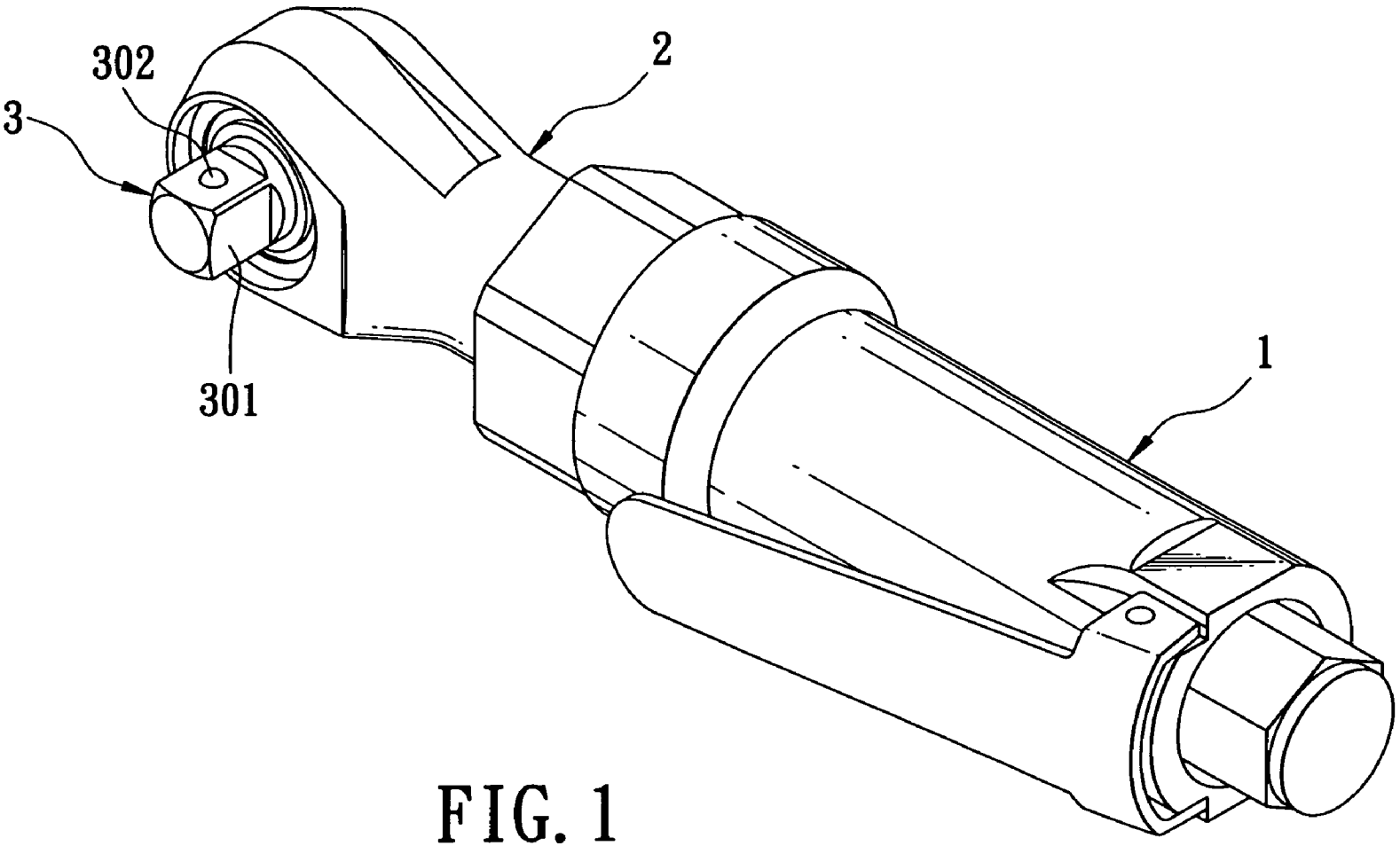
FIG. 1 PRIOR ART
FIG. 1 a perspective view of a pneumatic ratchet spanner that is provided with a conventional driving shaft.
Figure 2:
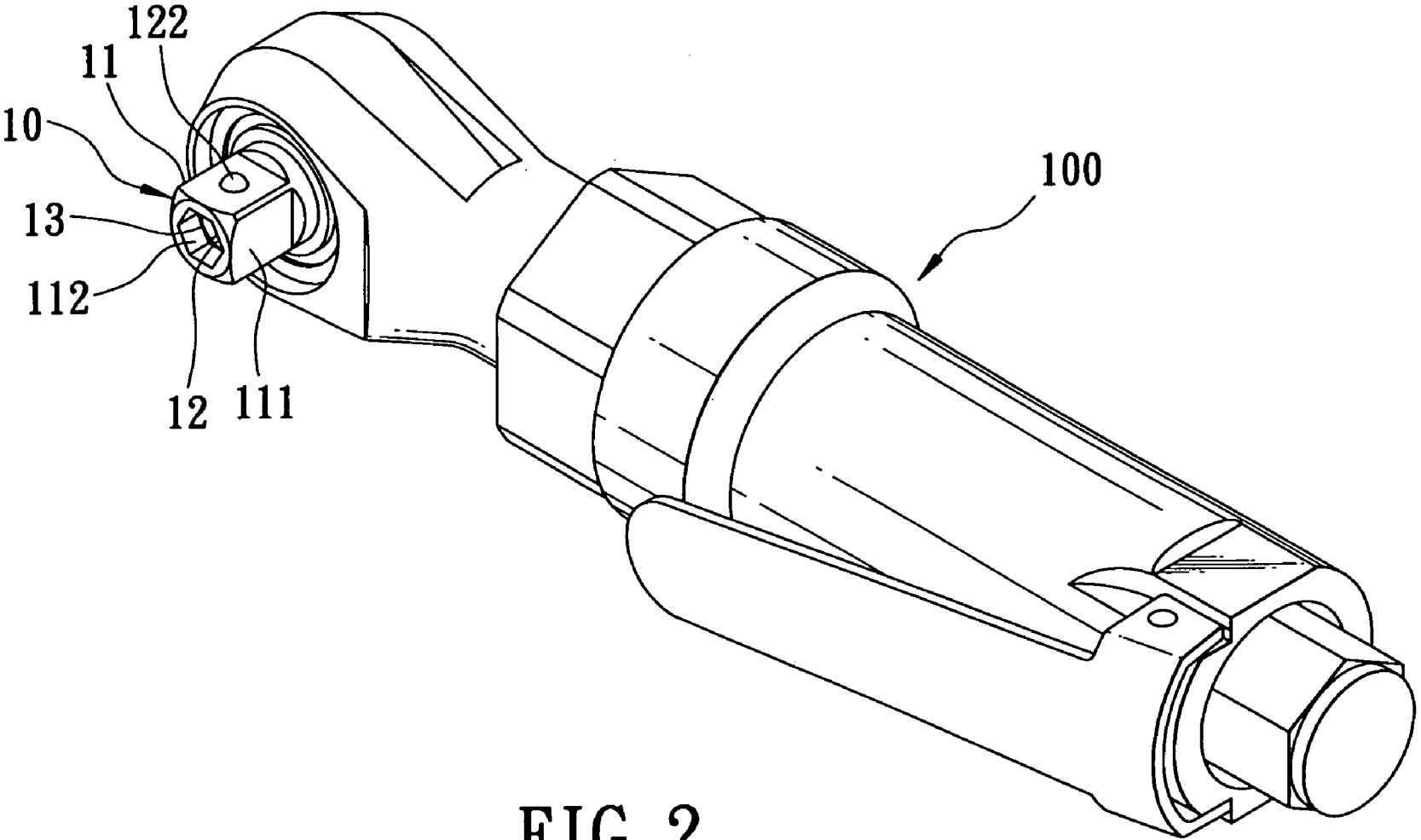
FIG. 2 is an assembled perspective view of a pneumatic ratchet spanner that is provided with the preferred embodiment of a driving shaft according to this invention.
Figure 3:
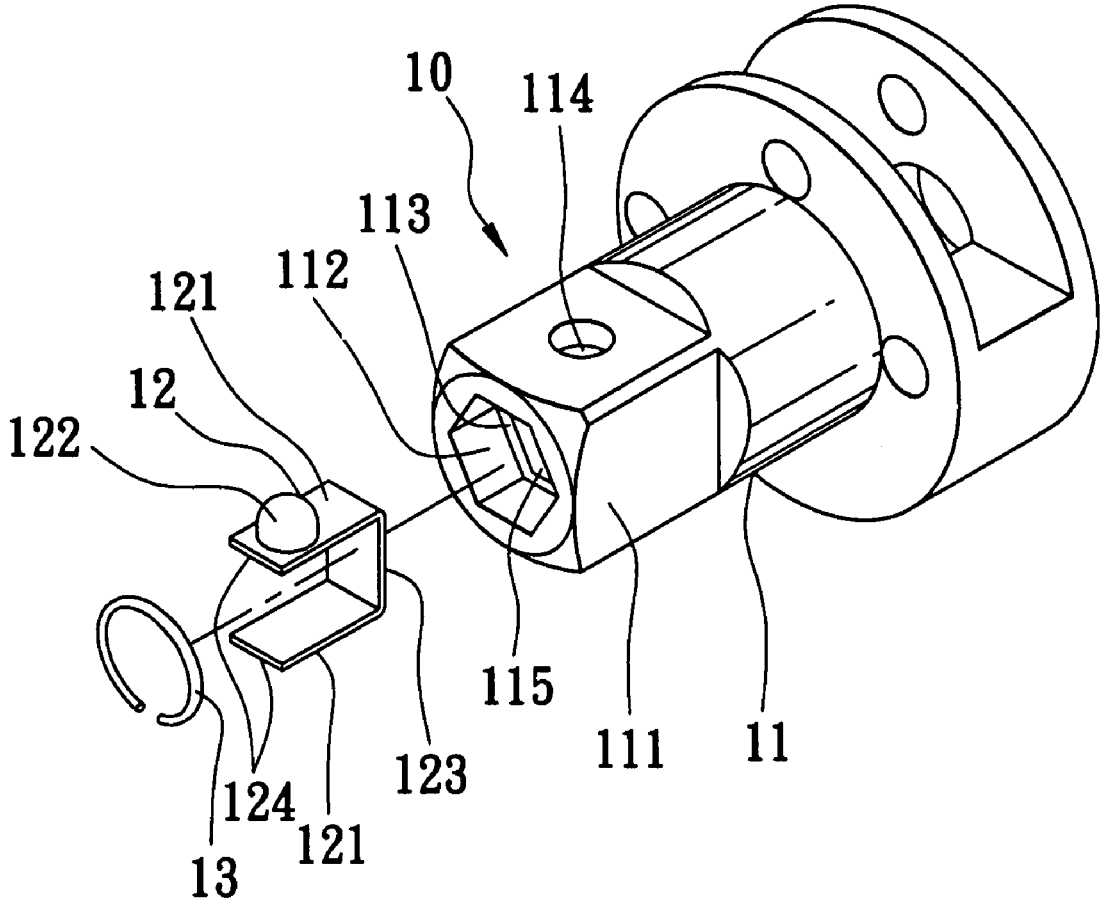
FIG. 3 is an exploded perspective view of the preferred embodiment.
Figure 4:
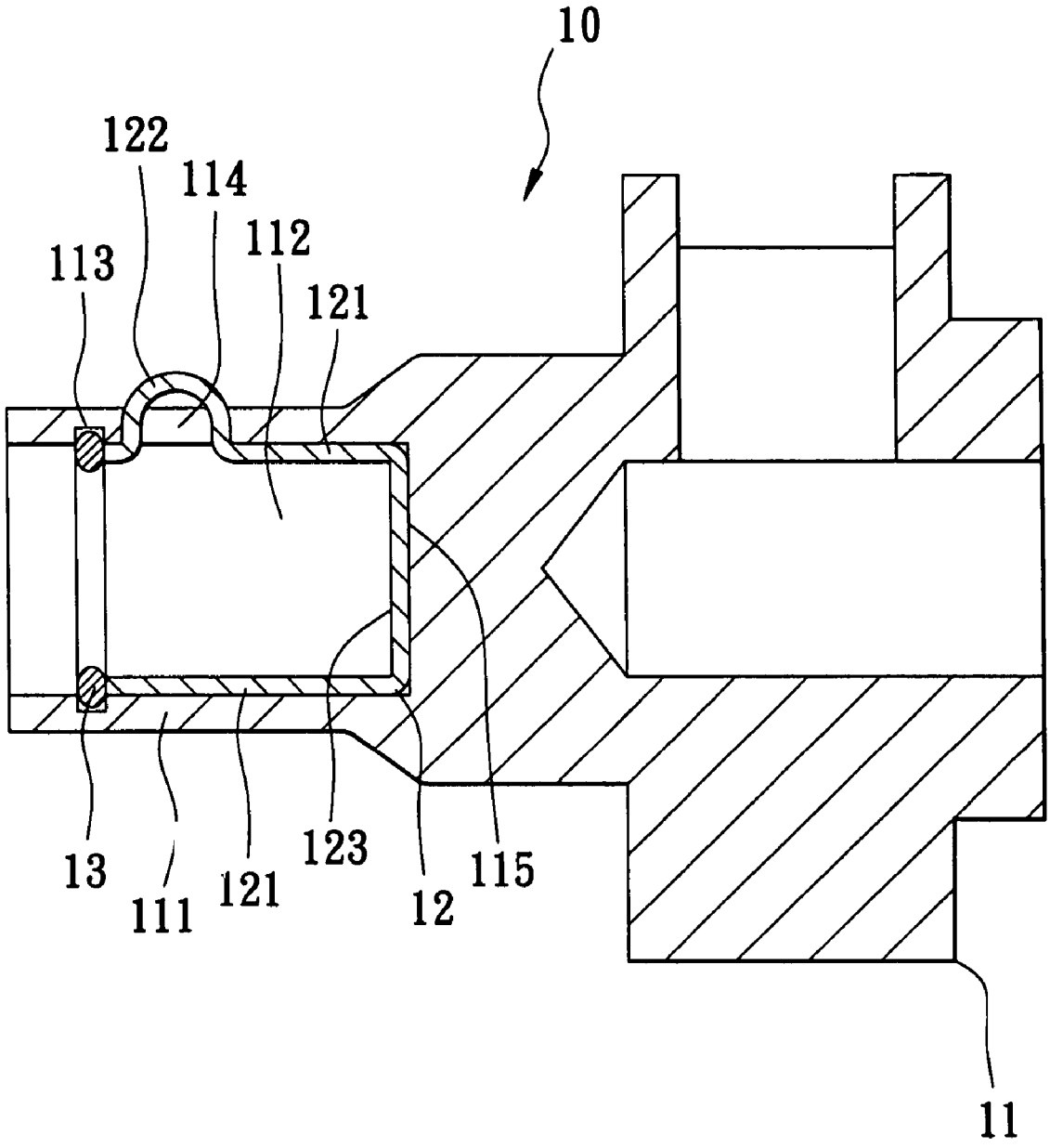
FIG. 4 is a sectional view of the preferred embodiment.

Referring to FIGS. 2, 3, and 4, the preferred embodiment of a driving shaft 10 according to this invention is disposed on a spanner body 100 of a pneumatic ratchet spanner, and is shown to include a shaft body 11, a sleeve-retaining member 12, and a C-shaped retaining ring 13.

Figure 5:
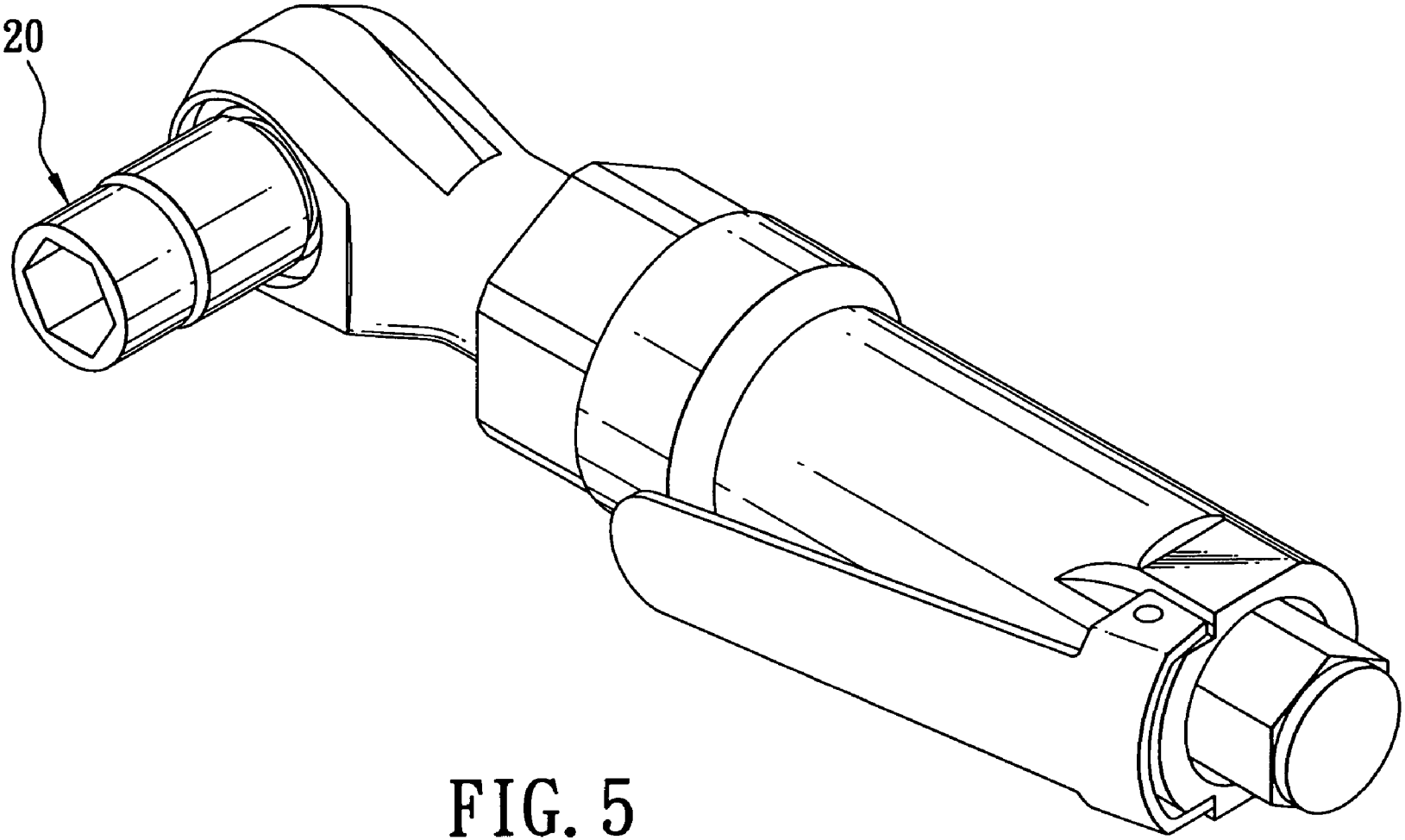
FIG. 5 is a schematic perspective view of the preferred embodiment, illustrating how the driving shaft is connected to a wrench.
Figure 6:
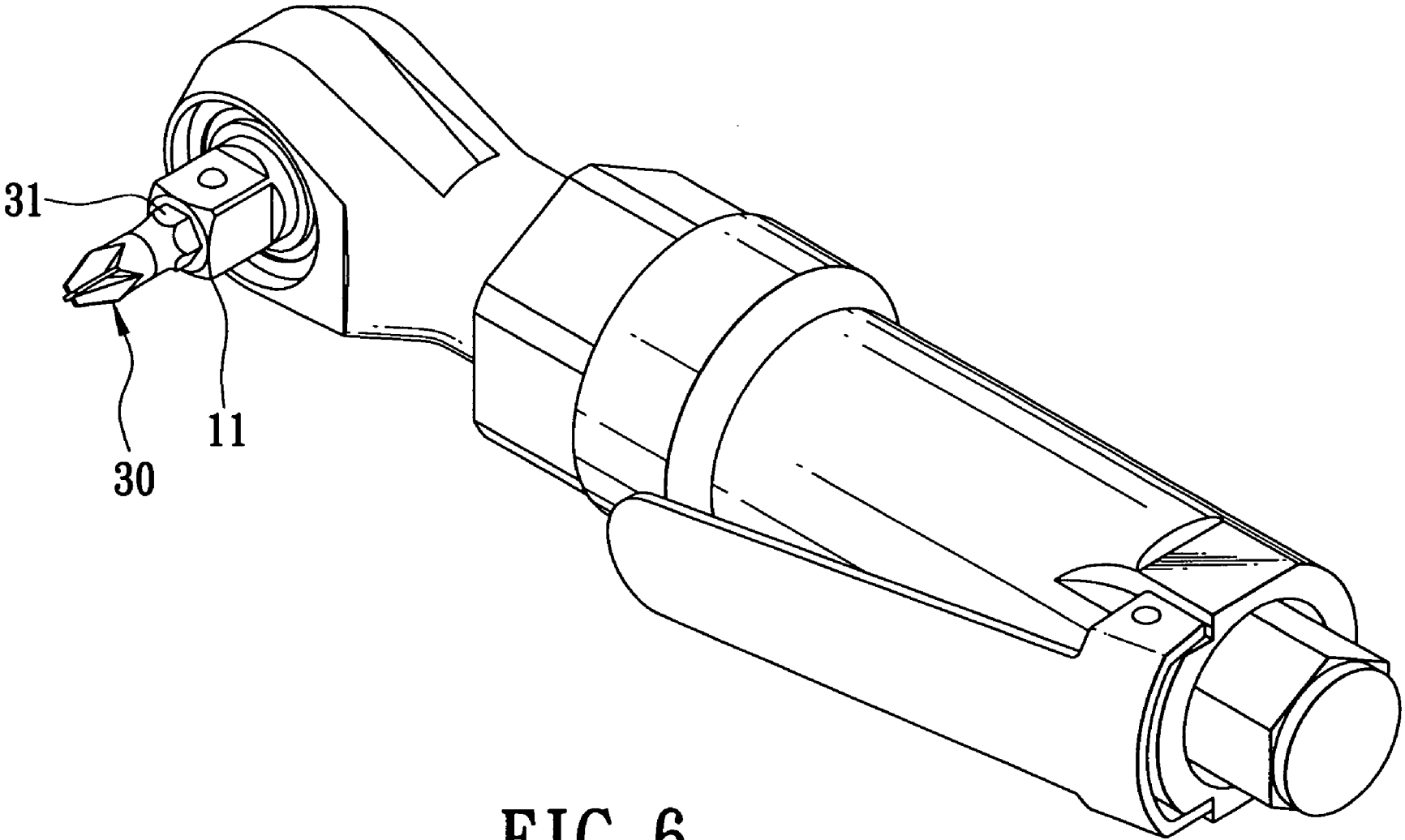
FIG. 6 is a schematic perspective view of the preferred embodiment, illustrating how the driving shaft is connected to a screwdriver.

The shaft body 11 is journalled on the spanner body 100 in a known manner, and has a polygonal driving end 111 that is adapted to be received fittingly within a wrench sleeve 20 (see FIG. 5) and that has an end surface with a polygonal screwdriver-engaging groove 112 adapted for receiving a polygonal head 31 (see FIG. 6) of a screwdriver 30 (see FIG. 6) fittingly, an annular inner surface that defines the screwdriver-engaging groove 112 therein and that is formed with an annular groove 113, an annular outer surface that is formed with a hole 114 communicated with the screwdriver-engaging groove 112, and a polygonal planar surface 115 that defines a closed end of the screwdriver-engaging groove 112. The annular groove 112 is located between the hole 114 and the end surface of the driving end 111 of the shaft body 11.

The sleeve-retaining member 12 is disposed within the screwdriver-engaging groove 112 in the end surface of the driving end 11 of the shaft body 10, and is configured as a U-shaped reed spring that includes two parallel side plates 121, a projection 122 formed integrally with one of the side plates 121, and an elongated connecting plate 123 that has two ends formed respectively and integrally with the side plates 121 and that abuts against the polygonal planar surface 115 of the driving end 111 of the shaft body 11. The side plates 121 of the sleeve-retaining member 12 abut against the annular inner surface of the driving end 111 of the shaft body 11, and are adapted to flank and abut against the head 31 (see FIG. 6) of the screwdriver 30 (see FIG. 6). The projection 122 extends through the hole 114 in the shaft body 11, and is adapted to be biased to press against the wrench sleeve 20 (see FIG. 5) so as to retain the wrench sleeve 20 (see FIG. 5) on the driving end 11 of the driving shaft 10. Preferably, the sleeve-retaining member 12 is magnetized so as to attract magnetically the wrench sleeve 20 (see FIG. 5) and the head 31 (see FIG. 6) of the screwdriver 30, thereby facilitating operation of the driving shaft 10 during use.

The C-shaped retaining ring 13 is received within the annular groove 113 in the shaft body 11, and abuts against free ends 124 of the side plates 121 of the sleeve-retaining member 12 so as to fix the sleeve-retaining member 12 within the screwdriver-engaging groove 112 in the shaft body 11.

Figure 7:
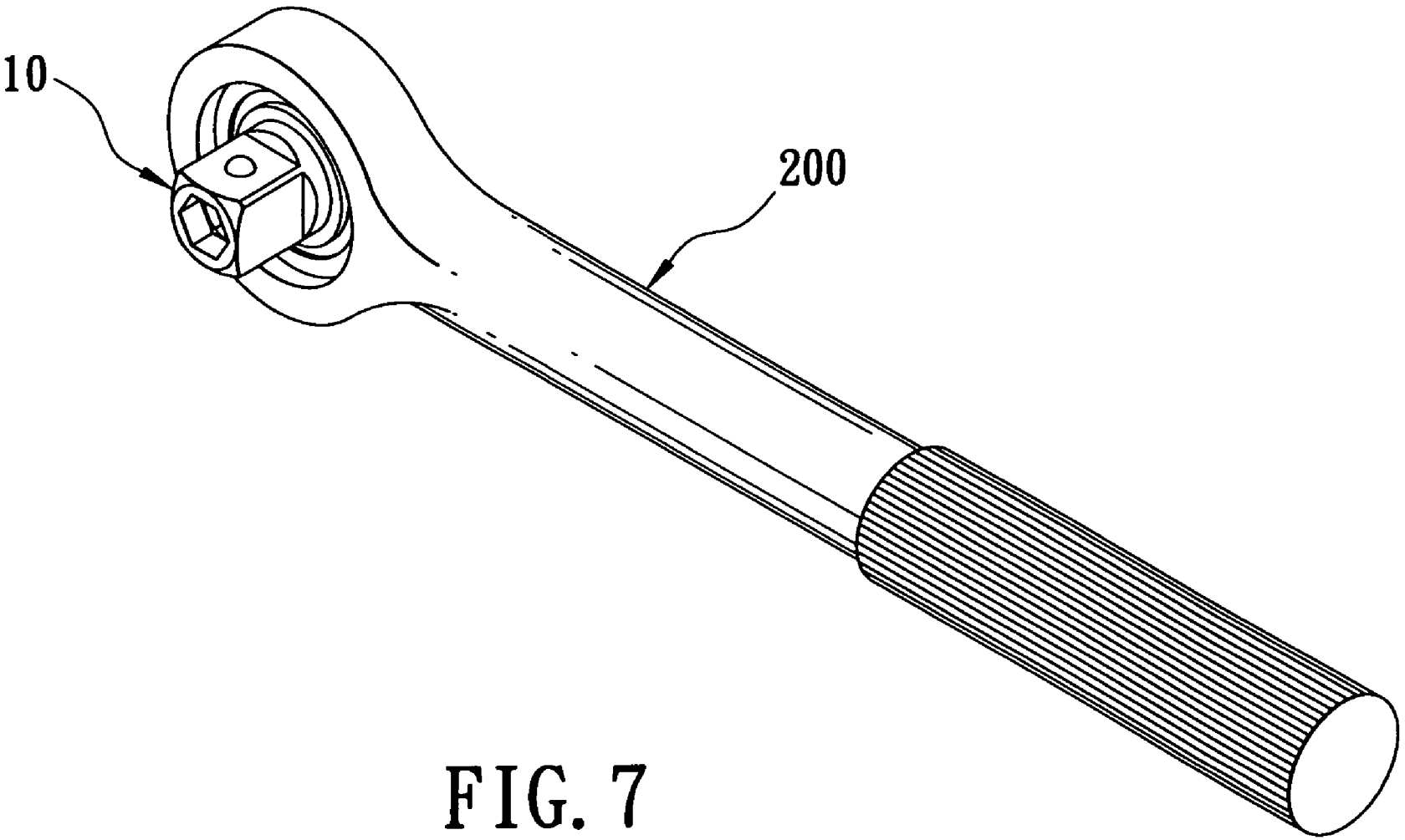
FIG. 7 is a perspective view of a manual ratchet spanner that is provided with the preferred embodiment.

Referring to FIG. 7, the driving shaft 10 of this invention can also be applied to a manual ratchet spanner 200.

With this invention thus explained, it is apparent that numerous modifications and variations can be made without departing from the scope and spirit of this invention. It is therefore intended that this invention be limited only as indicated by the appended claims.

I claim:

1. A driving shaft for a ratchet spanner, the ratchet spanner having a spanner body and being connected to a selected one of a wrench sleeve and a polygonal head of a screwdriver, said driving shaft being adapted to be journalled on the spanner body and comprising:

a shaft body including a polygonal driving end that is adapted to be received fittingly within the wrench sleeve and that has an end surface with a polygonal screwdriver-engaging groove adapted for receiving the head of the screwdriver fittingly, an annular outer surface that is formed with a hole communicated with said screwdriver-engaging groove in said end surface, and an annular inner that defines said surface screwdriver-engaging groove therein; and a sleeve-retaining member disposed within said screwdriver-engaging groove in said end surface of said driving end of said shaft body and having an integral projection that extends through said hole in said annular outer surface of said driving end of said shaft body and that is adapted to be biased to press against the wrench sleeve so as to retain the wrench sleeve on said driving end of said shaft body, wherein said sleeve-retaining member is configured as a U-shaped reed spring that includes two parallel side plates which abut against said annular inner surface of said driving end of said shaft body, said side plates of said sleeve-retaining member being adapted to flank and abut against the head of the screwdriver, said integral projection being formed integrally with one of said side plates of said sleeve-retaining member.

2. The driving shaft as claimed in claim 1, wherein said driving end of said shaft body further has a polygonal planar surface that defines a closed end of said screwdriver-engaging groove in said end surface of said driving end of said shaft body, said sleeve-retaining member further including an elongated connecting plate that has two ends formed respectively and integrally with said side plates and that abuts against said polygonal planar surface of said driving end of said shaft body, each of said side plates of said sleeve-retaining member having a free end, said annular inner surface of said driving end of said shaft body being formed with an annular groove, said driving shaft further comprising a C-shaped retaining ring that is received within said annular groove in said annular inner surface of said driving end of said shaft body and that abuts against said free ends of said side plates of said sleeve-retaining member so as to fix said sleeve-retaining member within said screwdriver-engaging groove in said driving end of said shaft body.

3. The driving shaft as claimed in claim 2, wherein said sleeve-retaining member is magnetized, and is adapted to attract magnetically the wrench sleeve and the head of the screwdriver so as to facilitate operation of said driving shaft during use.

* * * * *